US010137719B2

(12) United States Patent
Nakanishi et al.

(10) Patent No.: US 10,137,719 B2
(45) Date of Patent: Nov. 27, 2018

(54) BOOK BINDING APPARATUS

(71) Applicant: Horizon International Inc., Takashima-shi, Shiga (JP)

(72) Inventors: Hirohito Nakanishi, Takashima (JP); Shigenobu Fukuda, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 0 days.

(21) Appl. No.: 15/768,619

(22) PCT Filed: May 16, 2016

(86) PCT No.: PCT/JP2016/064435

§ 371 (c)(1),
(2) Date: Apr. 16, 2018

(87) PCT Pub. No.: WO2017/199277

PCT Pub. Date: Nov. 23, 2017

(65) Prior Publication Data

US 2018/0304664 A1 Oct. 25, 2018

(51) Int. Cl.

| | |
|---|---|
| ***B42C 19/08*** | (2006.01) |
| ***B42C 9/00*** | (2006.01) |
| ***B42C 1/12*** | (2006.01) |

(52) U.S. Cl.

CPC ..... *B42C 19/08* (2013.01); *B42C 1/12* (2013.01); *B42C 9/0018* (2013.01)

(58) Field of Classification Search

CPC ..... B42C 19/08; B42C 1/12; B42C 9/0018
See application file for complete search history.

(56) References Cited

U.S. PATENT DOCUMENTS

| | | | | |
|---|---|---|---|---|
| 5,193,962 | A * | 3/1993 | Parker | B42C 9/0056 156/908 |
| 5,632,587 | A * | 5/1997 | Coyette | B42C 9/0031 270/52.18 |
| 6,019,560 | A * | 2/2000 | Uchida | B42C 1/00 412/11 |
| 6,032,784 | A * | 3/2000 | Bellanca | B65G 47/252 198/406 |
| 7,357,244 | B2 * | 4/2008 | Grewe | B42C 19/08 198/459.2 |

(Continued)

OTHER PUBLICATIONS

International Search Report dated Jul. 12, 2016, issued in counterpart International Application No. PCT/JP2016/064435 (2 pages).

*Primary Examiner* — Patrick H Mackey
(74) *Attorney, Agent, or Firm* — Westerman, Hattori, Daniels & Adrian, LLP

(57) ABSTRACT

A book binding apparatus is provided with a conveyor belt 5 having a book block conveyance surface 13 extending obliquely downward toward a pair of clamp plates 3 and 4 of a clamper 2 at a book block supply position A. A guide plate 21 is attached to the clamp plate 4 on the conveyor belt side and can swing between a standing position and a tilted position. When the pair of clamp plates is placed in a closed position, the guide plate is held in the standing position. When the pair of clamp plates is placed in an open position at the book block supply position, the guide plate swings from the standing position to the tilted position and connects to the book block conveyance surface.

5 Claims, 6 Drawing Sheets

(56) References Cited

U.S. PATENT DOCUMENTS

| | | | | |
|---|---|---|---|---|
| 7,927,053 | B2 * | 4/2011 | Brommer | B42C 19/08 412/19 |
| 7,963,733 | B2 * | 6/2011 | Marsh | B41J 3/44 118/118 |
| 8,132,995 | B2 * | 3/2012 | Adler | B42C 19/08 412/11 |
| 8,151,971 | B2 * | 4/2012 | Baldanza | B65G 47/252 198/408 |
| 8,770,382 | B2 * | 7/2014 | Tas | B65G 47/244 198/377.03 |
| 8,915,349 | B2 * | 12/2014 | Tas | B65G 29/02 198/377.03 |
| 2011/0110747 | A1 * | 5/2011 | Marsh | B26D 1/085 412/1 |

* cited by examiner

BOOK BINDING APPARATUS

TECHNICAL FIELD

The present invention relates to a book binding apparatus, particularly to a book binding apparatus carrying out perfect binding.

BACKGROUND ART

A conventional book binding apparatus carrying out perfect binding is disclosed in Patent Document 1.

The book binding apparatus disclosed in Patent Document 1 has a clamper movable along a predetermined path while gripping a book block in a standing state, a series of processing units (a milling unit, a glue application unit and a cover attachment unit) arranged along the path to carry out perfect binding, and a book block supplying unit arranged at a book block supply position upstream of the series of processing units on the path to supply the book block to the clamper.

The clamper includes a pair of clamp plates movable between an open position in which the pair of clamp plates receives the book block therebetween and a closed position in which the pair of clamp plates grips the book block therebetween. When the clamper is arranged at the book block supply position, the book block is supplied from the book block supplying unit to a gap between the pair of clamp plates which takes the open position, and the pair of clamp plates takes the closed position, thereafter, the book block is bounded while the clamper leaving the book block supply position and passing through the series of processing units.

The book block supplying unit is arranged downstream of a sheet stacking unit. The sheet stacking unit sequentially and horizontally stacks sheets discharged from a printer or a copier to form a book block.

The book block supplying unit comprises a conveying section which receives the book block from the sheet stacking unit and conveys the book block horizontally, and a pivoting section which receives the book block from the conveying section and pivots the book block through an angle of 90 degrees to set the book block in a standing state at a book block supply position.

The conveying section of the book block supplying unit comprises a horizontal transfer table provided with slots extending in a direction of conveying the book block, a pair of rollers spaced from each other in the conveying direction under the transfer table and extended perpendicular to the conveying direction, an endless belt extended between the pair of rollers, a drive mechanism rotating the pair of rollers, and a plurality of dogs fixed to the endless belt to project upward from the slots of the transfer table.

Thus the dogs are moved in the conveying direction on the transfer table by rotation of the endless belt and thereby, the book block in a state of lying is pressed by the dog at a fore edge thereof so that the book block is horizontally conveyed toward the pivoting section.

The pivoting section of the book block supplying unit comprises a pair of jaws movable between an open position in which the pair of jaws receives the book block therebetween and a closed position in which the pair of jaws grips the book block therebetween, an abutment arranged at a right angle to the pair of jaws and opposite to a gap between the jaws, and a mechanism rotating the pair of jaws and the abutment in an integrated manner around a horizontal axis which is positioned below the book block supply position and extended at a right angle to the conveying direction of the conveying section between a horizontal position (in which the pair of jaws horizontally extends) and a vertical position rotated 90 degrees from the horizontal position.

Thus when the pair of jaws and abutment take the horizontal position and the pair of jaws takes the open position, the book block is inserted into a gap between the pair of jaws by the conveying section until the book block abuts with the abutment at a spine thereof, and then the pair of jaws takes the closed position and the pair of jaws as well as the abutment take the vertical position, whereby the book block is set at the book block supply position.

Next, the clamper enters and stops at the book block supply position while keeping the pair of clamp plates thereof in the open position. At this time a portion of the book block between the pair of jaws and abutment is inserted into the gap of the pair of clamp plates.

After that, the pair of clamp plates takes the closed position and the pair of jaws takes the open position. Thereby the supply of the book block from the book block supplying unit to the pair of clamp plates of the clamper is completed, and the clamper leaves the book block supply position while gripping the book block and the pair of jaws and abutment of the book block supplying unit take the horizontal position.

However, according to this configuration, the book block formed by the sheet stacking unit is conveyed in a lying state by the conveying unit and rotated 90 degrees to a standing state by the pivoting unit, which leads to the following problems: The book block supplying unit takes a long time to supply the book block to the clamper and thereby the production efficiency decreases, and the book block supplying unit becomes larger and complicated and thereby the downsizing of the unit is hindered and the manufacturing cost increases

PRIOR ART DOCUMENTS

Patent Documents

Patent Document 1: U.S. Pat. No. 5,632,587

SUMMARY OF THE INVENTION

Problems to be Solved by the Invention

It is, therefore, an object of the present invention to provide a book binding apparatus having a simple and low-cost structure and capable of smoothly supplying a book block to a clamper.

Means for Solving the Problems

In order to achieve the object, the present invention provides a book binding apparatus comprising: one or more clampers movable along a predetermined path while gripping a book block in a standing state, each of the clampers including a pair of clamp plates movable between an open position in which the pair of clamp plates receives the book block therebetween and a closed position in which the pair of clamp plates grips the book block therebetween; a series of processing units arranged along the path to carry out perfect binding; and a book block supplying unit arranged at a book block supply position upstream of the series of processing units on the path to supply the book block to the pair of clamp plates of the clamper, wherein when the clamper is arranged at the book block supply position, the book block is supplied from the book block supplying unit to a gap between the pair of clamp plates which takes the open position, and the pair of clamp plates takes the closed position, thereafter, the book block is bounded while the clamper leaving the book block supply position and passing through the series of processing units, characterized in that the book block supplying unit is arranged at one side of the book block supply position in a direction of the path, and includes a book block conveying surface extending at a right angle to and obliquely downward toward the pair of clamp plates at the book block supply position, the book block being conveyed to the pair of clamp plates on the book block conveying surface with a spine in the head thereof, wherein the clamper includes: a guide plate attached to a top end of one of the pair of clamp plates so as to be rotatable around a horizontal pivot extending at a right angle to a direction of conveying the book block by the book block conveying unit, the one of the pair of clamp plates being nearest to the book block supplying unit at the book block supply position, the guide plate being movable between a standing position in which the guide plate upwardly extends from and along the associated clamp plate and a tilted position in which the guide plate tilts outward from the standing position; and a spring arranged between the guide plate and pivot to constantly bias the guide plate toward the standing position, wherein the book binding apparatus comprises a guide plate drive mechanism arranged independently of or at the clamper to rotate the guide plate of the clamp plate from the standing position to the tilted position against the biasing force of the spring in such a manner that the guide plate is connected to the book block conveying surface when the pair of clamp plates takes the open position at the book block supply position.

According to a preferred embodiment of the present invention, the guide plate has a lever-like extension portion rotatable around the pivot together with the guide plate at least at one end of the pivot, the extension portion taking a first position when the guide plate takes the standing position and a second position when the guide plate takes the tilted position, wherein the guide plate drive mechanism is arranged independently of the clamper in such a manner that the guide plate drive mechanism can rotate the extension portion of the guide plate from the first position to the second position when the pair of clamp plates takes the open position at the book block supply position.

According to another preferred embodiment of the present invention, the guide plate drive mechanism is a linear actuator.

According to further preferred embodiment of the present invention, the book block supplying unit is a conveyer belt or a chute.

Effect of the Invention

According to the present invention, the book block supplying unit includes the book block conveying surface extending at a right angle to and obliquely downward toward the pair of clamp plates at the book block supply position, and the guide plate is attached to the top end of one of the pair of clamp plates which is nearest to the book block supplying unit in such a manner that the guide plate is movable between the standing position and the tilted position. When the pair of clamp plates takes the closed position, the guide plate is kept in the standing position, on the other hand, when the pair of clamp plates takes the open position at the book block supply position, the guide plate is rotated from the standing position to the tilted position so as to connect to the book block conveying surface.

Thus when the book block is supplied from the book block supplying unit to the clamper, a smooth conveying path is formed to extend from the book block conveying surface of the book block supplying unit to the clamp plate of the clamper through the guide plate, so that the book block is inserted into the gap between the pair of clamp plates in the open position.

Thereby the quick and smooth supply of a book block from a book block supplying unit to a clamper is achieved.

In addition, a structure of a book block supplying unit becomes compact and simplified so that the downsizing and cost reduction of a book block supplying unit is achieved.

BEST MODE FOR CARRYING OUT THE INVENTION

A preferred embodiment of the present invention will be explained below with reference to accompanying drawings.

Figure 1:
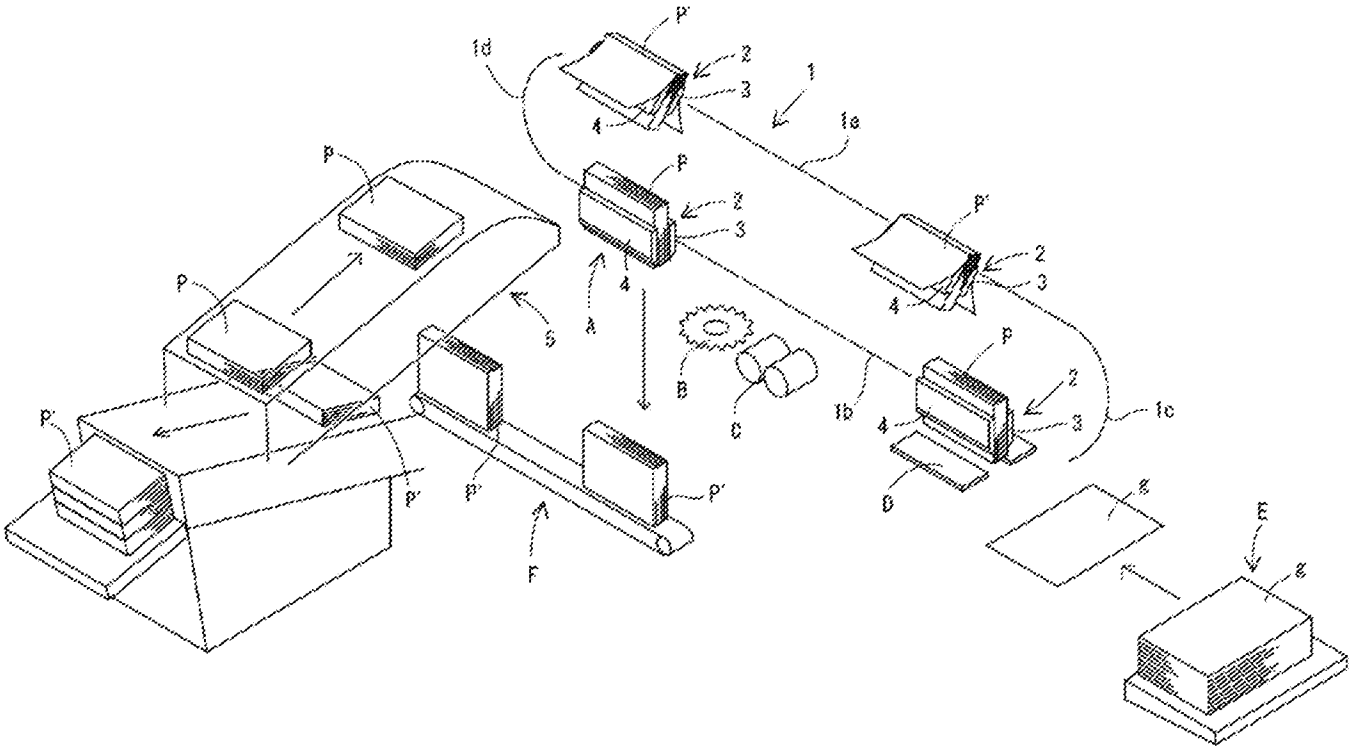
FIG. 1 is a perspective view schematically illustrating the whole configuration of a book binding apparatus according to an embodiment of the present invention.

FIG. 1 is a perspective view schematically illustrating the whole configuration of a bookbinding apparatus according to an embodiment of the present invention.

Referring to FIG. 1, according to the present invention, one or more (in this embodiment, four) clampers 2 are arranged so as to be movable along a predetermined path 1 while gripping a book block P in a standing state. Each of the clampers 2 includes a pair of clamp plates 3, 4 movable between an open position in which the pair of clamp plates 3, 4 receives the book block P therebetween and a closed position in which the pair of clamp plates 3, 4 grips the book block P therebetween.

In FIG. 1, for clarity, only the pairs of clamp plates 3, 4 are drawn on the behalf of the clampers 2.

In this embodiment, the path 1 of the clamper 2 is a loop path composed of horizontal upper and lower linear path portions 1*a*, 1*b* which are spaced from each other in a vertical plane and arcuate path portions 1*c*, 1*d* which connect ends of the upper and lower linear path portions 1*a*, 1*b*.

Not shown in the drawings, a guide is arranged along the path 1. The clampers 2 are slidably attached to the guide and movable along the path 1 while being guided by the guide.

The clampers 2 are moved only in one direction (counterclockwise direction in FIG. 1) along the path 1 by an appropriate well-known drive mechanism (not shown).

According to the present invention, a series of processing units (a milling unit B, a glue application unit C and a cover attachment unit D) are arranged along the lower linear path portion 1*b*. In FIG. 1, an alphabet E designates a cover supplying unit supplying a cover g to the cover attachment unit D.

A book block supply position A is provided upstream of the series of the processing units B-E on the lower linear path portion 1*b*. A book block supplying unit 5 is arranged on one side of the book block supply position A in a direction of the lower linear path portion 1*b* so as to supply the book block to a gap between the pair of clamp plates 3, 4 of the clamper 2.

Figure 2:
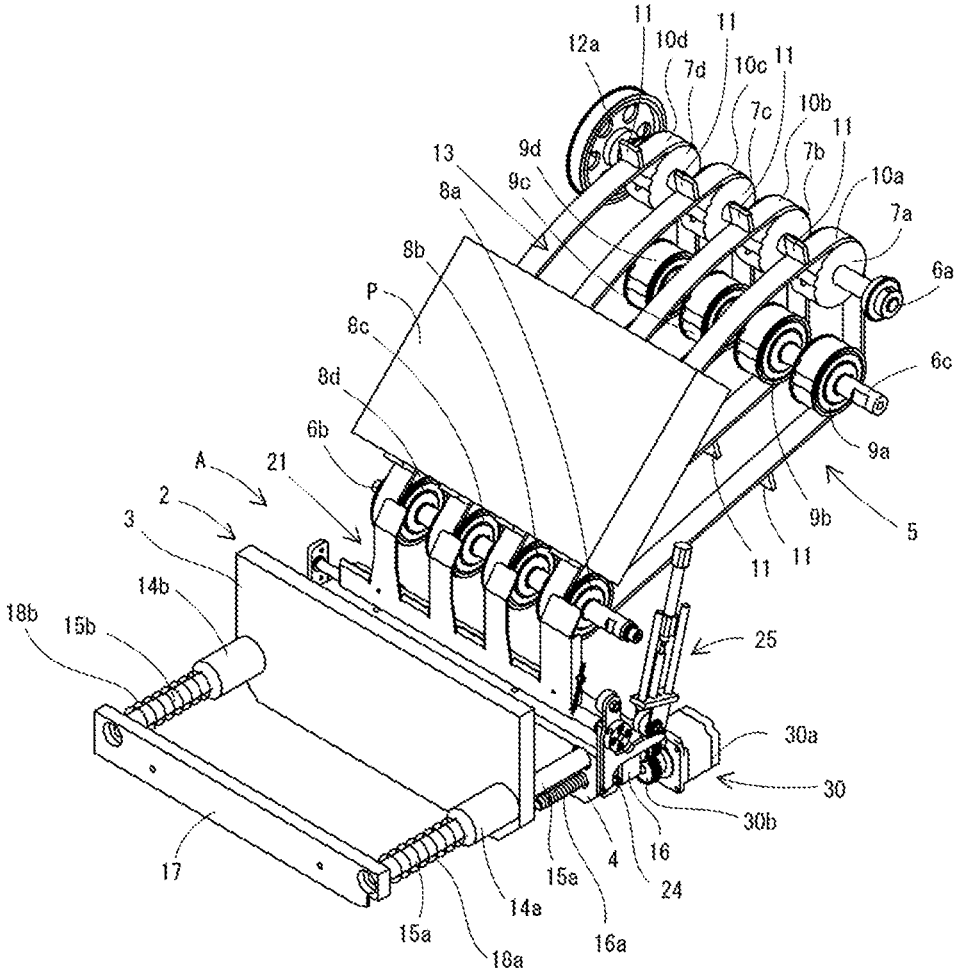
FIG. 2 is a perspective view illustrating a clamper positioned at a book block supply position and a book block supplying unit of the book binding apparatus shown in FIG. 1.
Figure 3:
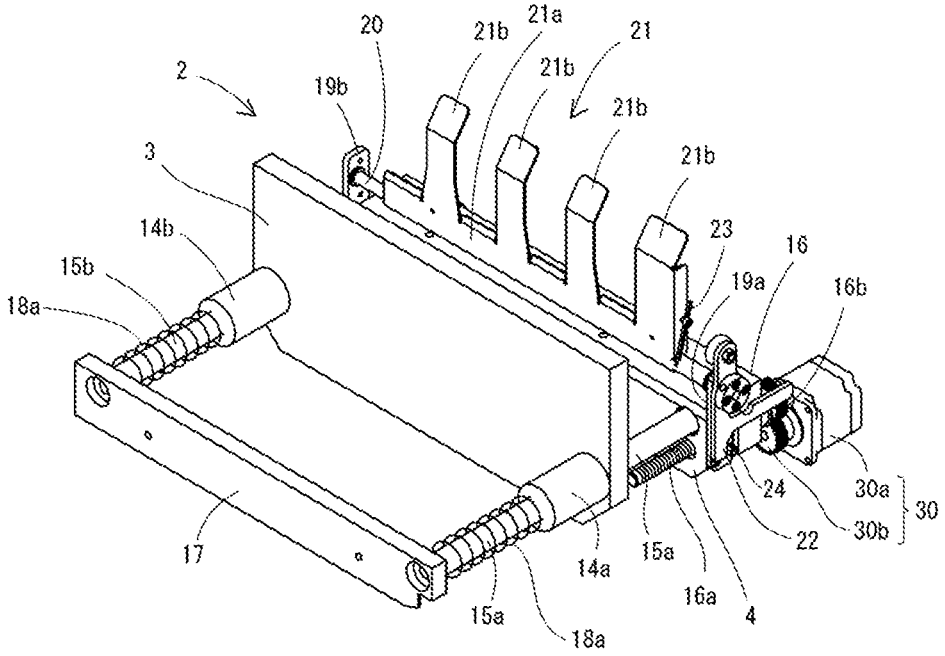
FIG. 3 is a perspective view of the clamper.
Figure 4B:
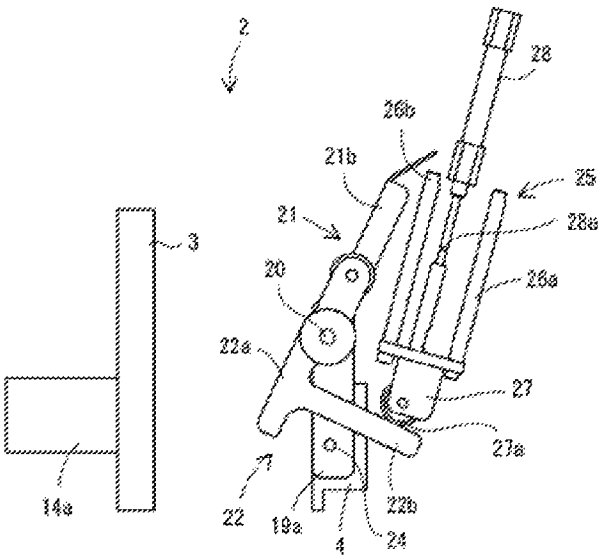
FIG. 4B is a side view of the clamper when the pair of clamp plates takes the open position and the guide plate takes a tilted position.
Figure 4A:
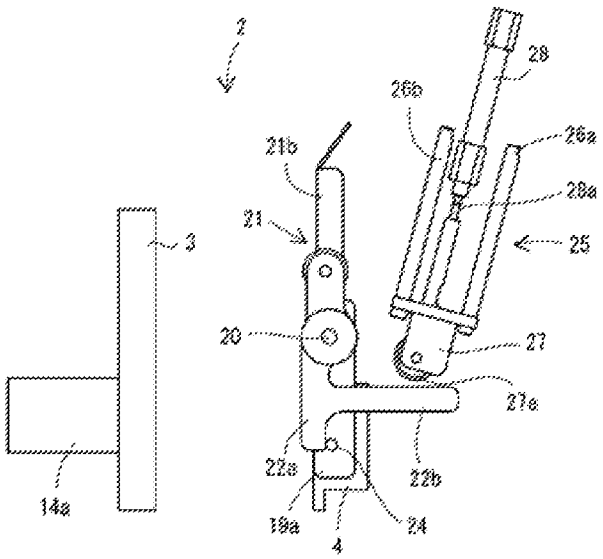
FIG. 4A is a side view of the clamper when a pair of clamp plates takes an open position and a guide plate takes a standing position.
Figure 5B:
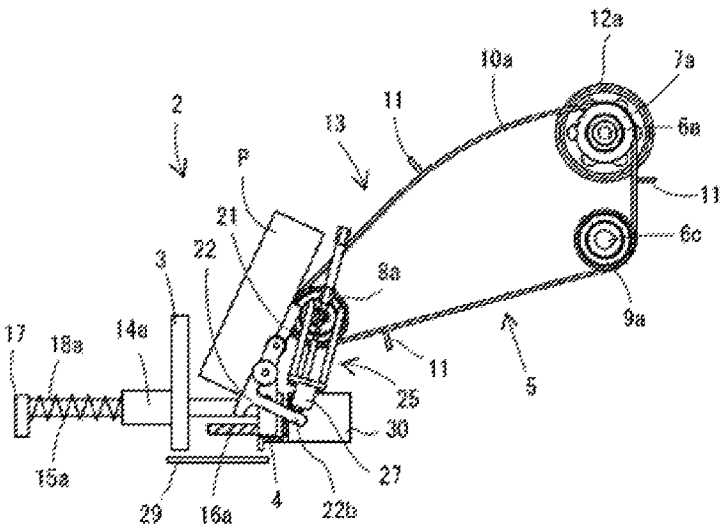
FIGS. 5A and 5B each is a side view illustrating an operating method of the book block supplying unit when a book block is supplied from the book block supplying unit to the clamper.
Figure 5A:
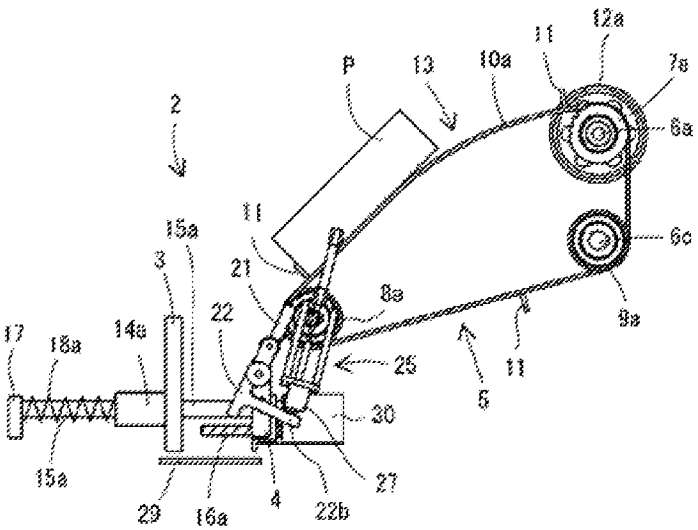

FIG. 2 is a perspective view illustrating the clamper positioned at the book block supply position and the book block supplying unit. FIG. 3 is a perspective view of the clamper. FIG. 4A is a side view of the clamper when the pair of clamp plates takes the open position and a guide plate takes a standing position, and FIG. 4B is a side view of the clamper when the pair of clamp plates takes the open position and the guide plate takes a tilted position.

Referring to FIG. 2, in this embodiment, the book block supplying unit 5 is a conveyer belt. The conveyer belt 5 is arranged obliquely upward of the book block supply position A and provided with a first rotating shaft 6*a* extending parallel with the lower linear path portion 1*b*, a second rotating shaft 6*b* arranged near the book block supply position A in a manner such that the second rotating shaft 6*b* extends parallel with the first rotating shaft 6*a* at a position lower than that of the first rotating shaft 6*a*, and a third rotating shaft 6*c* arranged underneath the first rotating shaft 6*a* in a manner such that the third rotating shaft 6*c* extends parallel with the first rotating shaft 6*a* at a position higher than that of the second rotating shaft 6*b*.

Not shown in the drawings, the first, second and third rotating shafts 6*a*-6*c* are supported by a conveyer frame so as to be rotatable around axes thereof.

A plurality of first roller elements 7*a*-7*d* are attached to the first rotating shaft 6*a* at intervals so as to be rotated with the first rotating shaft 6*a*. A plurality of second roller elements 8*a*-8*d* are attached to the second rotating shaft 6*b* at intervals therebetween so as to be rotated with the second rotating shaft 6*b*. A plurality of third roller elements 9*a*-9*d* are attached to the third rotating shaft 6*c* at intervals therebetween so as to be rotated with the third rotating shaft 6*c*.

Endless belts 10*a*-10*d* are extended between the first to third roller elements corresponding to each other 7*a*, 8*a*, 9*a*; 7*b*, 8*b*, 9*b*; 7*c*, 8*c*, 9*c*; 7*d*, 8*d*, 9*d* of the first to third rotating shafts 6*a*-6*c*. Portions of the endless belt 10*a*-10*d* extending between the first roller elements 7*a*-7*d* and second roller elements 8*a*-8*d* is supported by a support plate (not shown) at an underside thereof.

Plate-like protrusions 11 with which the spine of the book block P can contact are fixed on top surface of each of the endless belts 10*a*-10*d* in such a manner that the protrusions 11 are equally spaced from each other in a longitudinal direction of the associated conveyer belts 10*a*-10*d*.

A pulley 12*a* is mounted on one end of the first rotating shaft 6*a*. A motor (not shown) is attached to the conveyer frame and the pulley 12*a* is connected to the motor through a driving force transmission mechanism (not shown).

The conveyer frame (not shown), the first to third rotating shafts 6*a*-6*c*, the first to third roller elements 7*a*-7*d*; 8*a*-8*d*; 9*a*-9*d*, the endless belts 10*a*-10*d*, the support plate (not shown), the protrusions 11, the pulley 12*a*, the driving force transmission mechanism (not shown) and the motor (not shown) constitute the conveyer belt 5.

Also, a book block conveying surface 13 is formed by a top surface of a portion of the conveyer belt 5 which extends between the first and second roller elements 7*a*-7*d*, 8*a*-8*d*. The book block conveying surface 13 extends at a right angle to and obliquely downward toward the pair of clamp plates 3, 4 at the book block supply position A.

Thus the first rotating shaft 6*a* is rotated by the motor (not shown) and thereby, the endless belts 10*a*-10*d* are circulated so that the book block P is conveyed toward the pair of clamp plates 3, 4 while being pressed by the protrusions 11 at the spine thereof.

As shown in FIGS. 1-3, the pair of clamp plates 3, 4 of the clamper 2 is composed of a vertical fixed clamp plate 3 and a vertical movable clamp plate 4 which can be moved in directions toward and away from the fixed clamp plate 3.

The fixed clamp plate 3 is arranged parallel with the lower linear path portion 1*b* and provided with sleeves 14*a*, 14*b* at both ends thereof in a travelling direction. The sleeves 14*a*, 14*b* horizontally extends through the fixed clamp plate 3. Further, rods 15*a* and 15*b* are inserted into the sleeves 14*a* and 14*b* so as to be slidable along axes thereof, respectively.

One ends of the rods 15*a* and 15*b* (respective ends of the rods 15*a*, 15*b* closest to the conveyer belt 5 at the book block supply position A) are connected to each other by a support member 16. The other ends of the rods 15*a* and 15*b* (respective ends of the rods 15*a*, 15*b* far from the conveyer belt 5 at the book block supply position A) are connected to each other by a contact plate 17.

Furthermore, the movable clamp plate 4 is attached to the rods 15*a*, 15*b* so as to be slidable along the rods 15*a*, 15*b* parallel with the fixed clamp plate 3.

A threaded shaft 16*a* is attached to an end of the support member 16 in the travelling direction of the clamper 2 so as to be rotatable around an axis thereof. The threaded shaft 16*a* extends through the support member 16 parallel with the rods 15*a*, 15*b*. A threaded hole (not shown) is formed on the movable clamp plate 4 and the threaded shaft 16*a* engages with the threaded hole. A gear 16*b* is concentrically fixed to an end of the threaded shaft 16*a* far from the movable clamp plate 4.

Thus a gap distance between the support member 16 and the movable clamp plate 4, that is, a gap distance between a pair of the fixed and movable clamp plates 3, 4 in the open position thereof can be adjusted by rotating the gear 16*b* clockwise and counterclockwise.

On the other hand, a gap distance adjusting unit 30 is arranged below the lower linear path portion 1*b* at the book block supply position A. The gap distance adjusting unit 30 comprises a drive gear 30*b* engageable with the gear 16*b* of the clamper 2 when the pair of clamp plates 3, 4 of the clamper 2 takes the open position, and a motor 30*a* rotating the drive gear 30*b* when the pair of clamp plates 3, 4 of the clamper 2 takes the open position. The gap distance adjusting unit 30 can be movable in a vertical direction between a lowered position in which the gap distance adjusting unit 30 is retreated downward of the clamper 2 and a raised position in which the gap distance adjusting unit 30 engages the drive gear 30*b* with the gear 16*b* of the clamper 2.

Springs 18*a* and 18*b* are fitted in the outer periphery of the rods 15*a* and 15*b* between the sleeves 14*a*, 14*b* and contact plate 17, respectively. The springs 18*a*, 18*b* constantly bias the contact plate 17 in a direction away from the fixed clamp plate 3, that is, constantly bias the movable plate 4 in a direction toward the fixed clamp plate 3 so as to dispose the pair of clamp plates 3, 4 at the closed position.

Not shown in the drawings, a clamper releasing mechanism is arranged on an opposite side of the conveyer belt 5 across the lower linear path portion 1*b* at the book block supply position A. The clamper releasing mechanism is movable between a retreated position in which the clamper releasing mechanism is retreated from the contact plate 17 of the clamper 2 which is disposed at the book block supply position A and an actuating position in which the clamper releasing mechanism presses the contact plate 17 of the clamper 2 which is disposed at the book block supply position A toward the fixed clamp plate 3 against the biasing force of the springs 18*a*, 18*b* so as to separate the movable clamp plate 4 from the fixed clamp plate 3.

Thus when the clamper 2 is disposed at the book block supply position A, the clamper releasing mechanism moves from the retreated position to the actuating position so that the pair of clamp plates 3, 4 of the clamper 2 takes the open position.

Also, support plates 19*a*, 19*b* are fixed on both end faces of the movable clamp plate 4 in the travelling direction of the clamper 2 to protrude from a top end of the movable clamp plate 4. A horizontal rotating shaft 20 is supported by the support plates 19*a*, 19*b* and extended at a right angle to a direction of conveying the book block P by the conveyer belt 5.

A guide plate 21 is mounted on the rotating shaft 20 so as to be rotated with the rotating shaft 20.

In this embodiment, the guide plate 21 comprises an elongated plate-like base 21*a* extending along the rotating shaft 20 and a plurality of plate-like arms 21*b* extending from the base 21*a* in a radial direction of the rotating shaft 20. In this case, the arms 21*b* are arranged in a manner such that the arms 21*b* do not overlap with the endless belts 10*a*-10*d* of the conveyer belt 5.

The guide plate 21 is movable between a standing position in which the guide plate 21 extending upwardly from and along the movable clamp plate 4 (See FIG. 4A) and a tilted position in which the guide plate 21 tilts outward from the standing position (See FIG. 4B).

In this case, when the guide plate 21 takes the tilted position, the arms 21*b* of the guide plate 21 contact with a support plate (not shown) supporting the endless belts 10*a*-10*d* of the conveyer belt 5 at outwardly bent heads thereof so that the guide plate 21 smoothly connects to the book block supplying surface 13 of the conveyer belt 5.

The guide plate 21 further comprises a lever-like extension portion 22 rotatable around the rotating shaft 20 together with the guide plate 21 at one end of the rotating shaft 20.

In this embodiment, the extension portion 22 is in the form of L-shaped plate which comprises a first portion 22*a* extending from the rotating shaft 20 in the opposite direction to the arms 21*b*, and a second portion 22*b* extending at a right angle to the first portion 22*a* in a plane in which the first portion 22*a* rotates.

The extension portion 22 takes, as shown in FIG. 4A, a first position when the guide plate 21 takes the standing position, and, as shown in FIG. 4B, a second position when the guide plate 21 takes the tilted position.

A spring 23 is arranged between the guide plate 21 and rotating shaft 20 to constantly bias the guide plate 21 to the standing position from the tilted position. In this case, when the guide plate 21 takes the standing position, the first portion 22*a* of the extension portion 22 collides with a pin 24 attached to the movable clamp plate 4, thereby the guide plate 21 is forbidden to rotate toward the fixed clamp plate 3 from the standing position.

Furthermore, according to the present invention, a linear actuator 25 is arranged at the book block supply position A on the same side as the conveyer belt 5 with respect to the lower linear path portion 1*b* and attached to a frame (not shown) of the book binding apparatus independently of the clamper 2. The linear actuator 25 functions as a guide plate drive mechanism which can rotate the extension portion 22 of the guide plate 21 from the first position to the second position against the biasing force of the spring 23 when the pair of clamp plates 3, 4 of the clamper 2 takes the open position at the book block supply position A.

The linear actuator 25 comprises a pair of guide rods 26*a*, 26*b* attached to the frame of the book binding apparatus so as to be extended in a vertical direction above the second portion 22*b* of the extension portion 22 of the guide plate 21 when the pair of clamp plates 3, 4 of the clamper 2 takes the open position at the book block supply position A, and an actuating head 27 slidably attached to the guide rods 26*a*, 26*b* so as to be movable in directions toward and away from the extension portion 22*b* in a vertical plane containing a plane in which the extension portion 22 rotates. The actuating head 27 is provided with a roller 27*a* engageable with the second portion 22*b* at a head thereof.

The linear actuator 25 further comprises an air cylinder 28 attached to the frame to slide the actuating head 27. In this case, a head of a piston rod 28*a* of the air cylinder 28 is connected to a tail end of the actuating head 27.

Thus the piston rod 28*a* protrudes downward while the actuating head 27 (roller 27*a*) contacting with the second portion 22*b* of the extension portion 22 in the first position, thereby the extension portion 22 rotates from the first position to the second position, so that the guide plate 21 rotates from the standing position to the tilted position. When the piston rod 28*b* retreats from this position until the actuating head 27 (roller 27*a*) separates from the second portion 22*b* of the extension portion 22, the extension portion 22 returns to the first position through the biasing force of the spring 23, thereby the guide plate 21 returns to the standing position.

In this case, the linear actuator 25 retreats from the path 1 of the clamper 2 while the roller 27*a* of the actuating head 27 separating from the second portion 22*b* of the extension portion 22.

Next, an operating method of the book binding apparatus according to the present invention will be explained.

The clamper 2 stops at the book block supply position A and the book block P is supplied to the gap between the pair of clamp plates 3, 4 of the clamper 2 from the conveyer belt 5. FIGS. 5A, 5B, 6A and 6B illustrate an operation of supplying the book block from the conveyer belt 5 to the clamper 2.

As shown in FIGS. 5A, 5B, 6A and 6B, when the clamper 2 stops at the book block supply position A, the clamper releasing mechanism moves from the retreated position to the actuating position so that the pair of clamp plates 3, 4 takes the open position.

Then, if required, the gap distance adjusting unit 30 raises from the lowered position to the raised position to change the gap distance between the pair of clamp plates 3, 4 at the open position. In the case that this change is performed, a distance between the movable clamp plate 4 and the conveyer belt 5 at the open position of the pair of clamp plates 3, 4 is changed, and correspondingly a stroke of the linear actuator 25, that is, a turning angle of guide plate 21 from the standing position to the tilted position is also changed so that the smooth connection between the book block conveying surface 13 of the conveyer belt 5 and the movable clamp plate 4 through the guide plate 21 can be maintained.

Next, the extension portion 22 of the guide plate 21 of the movable clamp plate 4 is rotated from the first position to the second position by the linear actuator 25, and the guide plate 21 rotates from the standing position to the tilted position to connect to the book block conveying surface 13 of the conveyer belt 5. Thereby a smooth conveying path is formed to extend from the book block conveying surface 13 of the conveyer belt 5 to the movable clamp plate 4 of the clamper 2 through the guide plate 21 (See FIG. 5A).

Figure 6B:
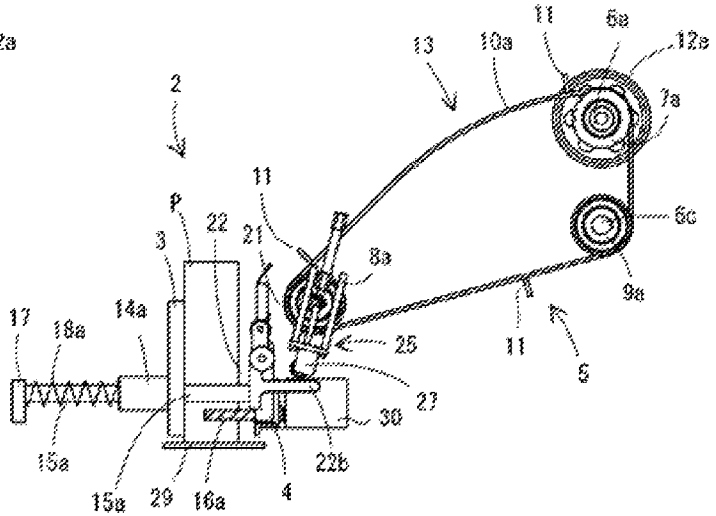
FIGS. 6A and 6B each is a side view illustrating an operating method of the book block supplying unit when a book block is supplied from the book block supplying unit to the clamper.
Figure 6A:
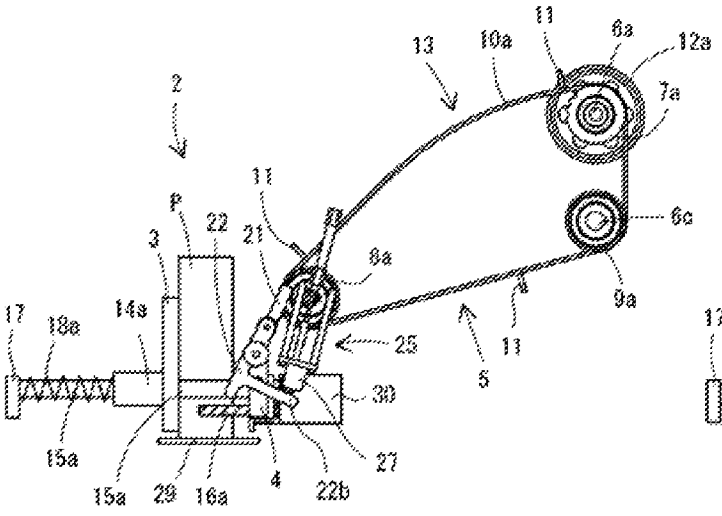

Then the book block P is conveyed to the guide plate 21 on the book block conveying surface 13 while being pushed by the protrusion 11 of the conveyer belt 5 at the spine thereof, falls along the guide plate 21, and inserted into the gap between the pair of clamp plates 3, 4 (See FIG. 6A). The book block P inserted between the pair of clamp plates 3, 4 is supported at a lower surface thereof by a horizontal book block support plate 29 which is disposed at the book block supply position A.

Thus the book block P is smoothly and quickly conveyed from the conveyer belt 5 to the clamper 2 while making a transition from a lying position to a standing position.

Next, the actuating head 27 (roller 27*c*) of the guide plate drive mechanism separates from the extension portion 22 of the guide plate 21 and the extension portion 22 rotates to the first position through the biasing force of the spring 23, so that the guide plate 21 rotates to the standing position (See FIG. 6B).

Further, the clamper releasing mechanism takes the retreated position, and the movable clamp plate 4 is pressed against the fixed clamp plate 3 by the springs 18*a*, 18*b*, thereby the pair of clamp plates 3, 4 takes the closed position so that the book block is gripped between the pair of clamp plates 3, 4, and the operation of supplying the book block P to the clamper 2 is completed.

Thereafter the book block support plate 29 retreats from the book block supply position A, after that, the clamper 2 leaves the book block supply position A and passes through the milling unit B, the glue application unit C and the cover attachment unit D, and the perfect binding of the book block P is carried out while the clamper passing through these units B-D. Then the clamper 2 gripping a product P' moves along the upper linear path portion 1*a* through the arcuate path portion 1*c* while being turned upside down, thereafter, moves along the lower linear path portion 1*b* again through the arcuate path portion 1*c* and stops at the book block supply position A. At the book block supply position A, the clamper releasing mechanism moves from the retreated position to the actuating position, whereby the pair of clamp plates 3, 4 takes the open position and the product P' is discharged on the product discharge unit F arranged below the clamper 2. After the product P' is discharged, a new book block P is supplied from the conveyer belt 5 to the clamper 2.

According to the present invention, the quick and smooth supply of a book block from a book block supplying unit to a clamper is achieved. Furthermore, a structure of a book block supplying unit becomes compact and simplified so that the downsizing and cost reduction of a book block supplying unit is achieved.

Although a preferred embodiment of the present invention has been explained, the present invention is not limited to the above-mentioned embodiment and one skilled in the art can easily create a variety of modifications within the scope of the attached claims.

For example, although the clamper path is in the form of a loop path and the plurality of clampers are provided in the above-mentioned embodiment, alternatively, an configuration in which the clamper path is in the form of a linear path and a single clamper moves reciprocally along the path is possible.

Although the book block supplying unit is in the form of the conveyer belt in the above-mentioned embodiment, the book block supplying unit may have any configuration, insofar as the book block supplying unit includes the book block conveying surface extending at a right angle to and obliquely downward toward the pair of clamp plates at the book block supply position and conveys the book block to the pair of clamp plates on the book block conveying surface with the spine in the head thereof. Therefore, the book block supplying unit may be, for example, a chute and so on.

Although the guide plate in provided with the lever-like extension portion and the guide plate drive mechanism is the linear actuator in the above-mentioned embodiment, the guide drive mechanism may have any configuration, insofar as the guide plate drive mechanism rotates the guide plate from the standing position to the tilted position against the biasing force of the spring when the pair of clamp plates of the clamper takes the open position at the book block supply position. In this case, a configuration for operatively connecting the guide plate drive mechanism to the guide plate is not limited to the above-mentioned embodiment.

Although the guide plate drive mechanism is arranged independently of the clamper in the above-mentioned embodiment, the guide plate drive mechanism may be arranged at the clamper. Also, although the guide plate is attached to the movable clamp plate, the guide plate is attached to the fixed clamp plate in the case that the fixed clamp plate is the nearest clamp plate to the book block supplying unit.

Further, a configuration of moving the clamp plates between the open position and the closed position is not limited to the above-mentioned embodiment, and the pair of clamp plates may be in the form of a pair of movable clamp plates which can be moved in directions toward and away from each other.

DESCRIPTION OF REFERENCE NUMERALS

1 Path
1*a* Upper linear path portion
1*b* Lower linear path portion
1*c* Arcuate path portion
2 Clamper
3 Fixed clamp plate
4 Movable clamp plate
5 Conveyer belt (Book block supplying unit)
6*a*-6*c* First to third rotating shafts
7*a*-7*d* First roller element
8*a*-8*d* Second roller element
9*a*-9*d* Third roller element
10*a*-10*d* Endless belt
11 Protrusion
12*a* Pulley
13 Book block conveying surface
14*a*, 14*b* Sleeve
15*a*, 15*b* Rod
16 Support member
16*a* Threaded shaft

16*b* Gear
17 Contact plate
18*a*, 18*b* Spring
19*a*, 19*b* Support plate
20 Rotating shaft
21 Guide plate
21*a* Base
21*b* Arm
22 Extension portion
22*a* First portion
22*b* Second portion
23 Spring
24 Pin
25 Linear actuator (Guide plate drive mechanism)
26*a*, 26*b* Guide rod
27 Actuating head
27*a* Roller
28 Air cylinder
28*a* Piston rod
29 Book block support plate
30 Gap distance adjusting unit
30*a* Motor
30*b* Drive gear
A Book block supply position
B Milling unit
C Glue application unit
D Cover attachment unit
E Cover supplying unit
F Product discharge unit
g Cover
P Book block
P' Product

The invention claimed is:

1. A book binding apparatus comprising:

one or more clampers movable along a predetermined path while gripping a book block in a standing state, each of the clampers including a pair of clamp plates movable between an open position in which the pair of clamp plates receives the book block therebetween and a closed position in which the pair of clamp plates grips the book block therebetween;

a series of processing units arranged along the path to carry out perfect binding; and a book block supplying unit arranged at a book block supply position upstream of the series of processing units on the path to supply the book block to the pair of clamp plates of the clamper, wherein when the clamper is arranged at the book block supply position, the book block is supplied from the book block supplying unit to a gap between the pair of clamp plates which takes the open position, and the pair of clamp plates takes the closed position, thereafter, the book block is bounded while the clamper leaving the book block supply position and passing through the series of processing units, and the book block supplying unit is arranged at one side of the book block supply position in a direction of the path, and includes a book block conveying surface extending at a right angle to and obliquely downward toward the pair of clamp plates at the book block supply position, the book block being conveyed to the pair of clamp plates on the book block conveying surface with a spine in the head thereof, wherein the clamper includes:

a guide plate attached to a top end of one of the pair of clamp plates so as to be rotatable around a horizontal pivot extending at a right angle to a direction of conveying the book block by the book block conveying unit, the one of the pair of clamp plates being nearest to the book block supplying unit at the book block supply position, the guide plate being movable between a standing position in which the guide plate upwardly extends from and along the associated clamp plate and a tilted position in which the guide plate tilts outward from the standing position; and a spring arranged between the guide plate and pivot to constantly bias the guide plate toward the standing position, wherein the book binding apparatus comprises a guide plate drive mechanism arranged independently of or at the clamper to rotate the guide plate of the clamp plate from the standing position to the tilted position against the biasing force of the spring in such a manner that the guide plate is connected to the book block conveying surface when the pair of clamp plates takes the open position at the book block supply position.

2. The book binding apparatus according to claim 1, wherein the guide plate has a lever-like extension portion rotatable around the pivot together with the guide plate at least at one end of the pivot, the extension portion taking a first position when the guide plate takes the standing position and a second position when the guide plate takes the tilted position, wherein the guide plate drive mechanism is arranged independently of the clamper in such a manner that the guide plate drive mechanism can rotate the extension portion of the guide plate from the first position to the second position when the pair of clamp plates takes the open position at the book block supply position.

3. The book binding apparatus according to claim 2, wherein the guide plate drive mechanism is a linear actuator.

4. The book binding apparatus according to claim 2, wherein the book block supplying unit is a conveyer belt.

5. The book binding apparatus according to claim 2, wherein the book block supplying unit is a chute.

* * * * *